US008317056B2

(12) United States Patent
Lee et al.

(10) Patent No.: US 8,317,056 B2
(45) Date of Patent: Nov. 27, 2012

(54) LIQUID TIGHT SEALING OF HEAT-INSULATING WALLS OF A LIQUEFIED NATURAL GAS CARRIER

(75) Inventors: Dai-Gil Lee, Daejeon (KR); Sang-Wook Park, Gwangju (KR); Byung-Chul Kim, Busan (KR); Seong-su Kim, Geoje (KR)

(73) Assignee: Korea Advanced Institute of Science and Technology (KR)

( * ) Notice: Subject to any disclaimer, the term of this patent is extended or adjusted under 35 U.S.C. 154(b) by 1025 days.

(21) Appl. No.: 11/777,155

(22) Filed: Jul. 12, 2007

(65) Prior Publication Data

US 2008/0011756 A1 Jan. 17, 2008

(30) Foreign Application Priority Data

Jul. 12, 2006 (KR) ..... 10-2006-0065294

(51) Int. Cl.

| | |
|---|---|
| ***F17C 1/06*** | (2006.01) |
| ***F17C 1/00*** | (2006.01) |
| ***F17C 3/00*** | (2006.01) |
| ***F17C 13/00*** | (2006.01) |

(52) U.S. Cl. ..... 220/560.12; 220/560.13; 220/590; 220/591; 220/901

(58) Field of Classification Search ..... 220/560.13, 220/590, 591, 901, 560.12
See application file for complete search history.

(56) References Cited

U.S. PATENT DOCUMENTS

| | | | | |
|---|---|---|---|---|
| 4,004,706 | A * | 1/1977 | Guldenfels et al. | 220/586 |
| 4,747,513 | A * | 5/1988 | Betille et al. | 220/560.12 |
| 4,774,118 | A * | 9/1988 | Davis et al. | 428/71 |
| 5,501,359 | A * | 3/1996 | Chauvin et al. | 220/592.26 |
| 5,586,513 | A * | 12/1996 | Jean et al. | 114/74 A |
| 5,749,331 | A * | 5/1998 | Pettersson et al. | 123/193.2 |
| 6,035,795 | A | 3/2000 | Dhellemmes et al. | |

FOREIGN PATENT DOCUMENTS

KR 10-0557354 B 3/2006

* cited by examiner

*Primary Examiner* — Anthony Stashick
*Assistant Examiner* — Andrew T Kirsch
(74) *Attorney, Agent, or Firm* — Knobbe Martens Olson & Bear, LLP

(57) ABSTRACT

A structure and method for bonding heat-insulating protection walls of a liquefied natural gas carrier is provided. Each of the heat-insulating protection walls is formed of an insulation foam layer and a fiber-reinforced composite reinforcing sheet attached to a surface of the insulation foam layer. The heat-insulating protection walls are provided in a tank of the liquefied natural gas carrier in a mutually adjoining relationship and bonded to one another at a junction to keep the tank cold. The structure includes a fiber-reinforced composite joint sheet positioned in alignment with the juncture of the heat-insulating protection walls and bonded to the fiber-reinforced composite reinforcing sheet by an adhesive agent and a spacer interposed between the fiber-reinforced composite reinforcing sheet and the fiber-reinforced composite joint sheet for keeping the adhesive agent uniform in thickness.

18 Claims, 11 Drawing Sheets

LIQUID TIGHT SEALING OF HEAT-INSULATING WALLS OF A LIQUEFIED NATURAL GAS CARRIER

CROSS-REFERENCE TO RELATED APPLICATION

This application claims priority to and the benefit of Korean Patent Application No. 10-2006-0065294, filed Jul. 12, 2006, the disclosure of which is incorporated herein by reference in its entirety.

BACKGROUND

1. Field

The present disclosure relates to a liquefied natural gas tank, and more particularly, to a heat-insulation structure of the liquefied natural gas tank.

2. Discussion of the Related Technology

A tank for liquefied natural gas carriers is designed to store and transport a liquefied natural gas cooled down to −175° C. and is made of stainless steel, e.g., STS304 or STS304L. The tank is constructed from an inner protection wall made of a cold insulator.

U.S. Pat. No. 6,035,795 discloses a technique of forming heat-insulating protection walls on an inner surface of a tank using a cold insulator made of sandwich foam and a glass fiber reinforced composite sheet. Korean Patent Publication No. 10-0557354B teaches a technique by which a triplex strip with a three-layered structure consisting of aluminum foils and glass fibers is bonded to a juncture of heat-insulating protection walls by means of a thermoplastic resin.

Meanwhile, in accordance with a exemplary structure for bonding heat-insulating protection walls of a liquefied natural gas carrier, a fiber-reinforced composite joint sheet is bonded to a juncture of heat-insulating protection walls in a single lap method. The bonding portion of the fiber-reinforced composite joint sheet is structurally weakest among other portions and heavily affects the strength of a bonded structure. Thus, it is of paramount importance to design and manufacture a bonded structure that can assure reliability.

In the exemplary structure for bonding heat-insulating protection walls of a liquefied natural gas carrier, however, the adhesive agent for bonding the juncture of cold insulators is very strong in brittleness. This poses a problem in that the fiber-reinforced composite joint sheets are apt to be fractured even with a light load and a liquefied natural gas may be leaked due to the fracture of the fiber-reinforced composite joint sheets.

Furthermore, a high molecular adhesive agent used in bonding the fiber-reinforced composite joint sheets is greater in thermal expansion coefficient than metal and a fiber-reinforced composite reinforcing sheet. Thus, a residual thermal stress is developed in the fiber-reinforced composite joint sheets and the adhesive agent due to the temperature difference generated during the course of charging a liquefied natural gas into a tank or discharging the liquefied natural gas from the tank. This residual thermal stress may create fine cracks and may lead to fatigue fractures. Moreover, the bonding strength becomes low if the adhesive agent is uneven in thickness, and the adhesive agent may not be applied to between the fiber-reinforced composite joint sheets, thereby reducing the bonding strength and the sealability.

The foregoing discussion is to provide general background information, and does not constitute of an admission of prior art.

SUMMARY

One aspect of the invention provides a liquefied natural gas tank, comprising: an interior wall configured to contact a liquefied natural gas; a first heat-insulation structure; a second heat-insulation structure interposed between the first heat-insulation structure and the interior wall; and wherein the first heat-insulation structure comprises: a first insulation wall comprising a first surface, a second insulation wall abutting the first insulation wall and comprising a second surface, a joint sheet comprising a first portion and a second portion, the first portion being placed over the first insulation wall, the second portion being placed over the second insulation wall, and a bonding layer placed between and bonding the first portion of the joint sheet and the first insulation wall, the bonding layer further placed between and bonding the second portion of the joint sheet and the second insulation wall, wherein the bonding layer comprises a bonding material and at least one device embedded in the bonding material, wherein the at least one device is configured to inhibit cracks from propagating in the bonding layer, wherein the bonding of the joint sheet with the first and second insulation walls forms a substantially liquid-tight sealing between the first and second insulation walls.

In the foregoing tank, the at least one device may further configured to maintain a substantially uniform thickness of the bonding layer. The at least one device may comprise at least one selected from the group consisting of a plurality of wires, a plurality of balls, a plurality of particles, a woven net of threads, and a lattice structure. The at least one device may comprise at least one selected from the group consisting of a plurality of metallic wires, a plurality of glass fibers, and a plurality of carbon fibers. The at least one device may comprise a woven net of a plurality of threads which comprise at least one of glass fiber strands and carbon fiber strands. The at least one device may comprise a lattice structure comprising a plurality of holes, wherein the bonding material is placed in at least part of the plurality of holes. The second heat-insulation structure may comprise a third insulation wall and a fourth insulation wall, which do not form a liquid-tight sealing therebetween. The third insulation wall may be integrated with the first insulation wall, wherein the fourth insulation wall may be integrated with the second insulation wall.

Still in the foregoing tank, the cracks may be to form in the bonding material as at least one of the joint sheet, the first insulating wall, the second insulating wall and the bonding material shrinks or expands upon a substantial change of a surrounding temperature. The first and second insulation walls may have a gap therebetween, and wherein the first heat-insulation structure may further comprise a filler placed in the gap, wherein the bonding layer may be formed further between the filler and the joint sheet. The joint sheet may comprise a fiber-reinforced resin. The first insulation wall may comprise a plurality of layers which comprises a top layer contacting the bonding layer, wherein the top layer comprises a fiber-reinforced resin.

Another aspect of the invention provides a ship comprising the foregoing tank, wherein the tank is integrated with a body of the ship. Still another aspect of the invention provides a vehicle comprising the foregoing tank, wherein the tank is integrated with a body of the vehicle. In the foregoing vehicle, the vehicle may be selected from the group consisting of a train, a car and a trailer.

Yet another aspect of the invention provide a method of minimizing damage to liquid-tight sealing in loading of liquefied natural gas into a tank, the method comprising: providing the foregoing tank; loading liquefied natural gas into the tank, which substantially lowers a temperature surrounding the bonding layer, causing to shrink at least one of the joint sheet, the first insulating wall, the second insulating wall and the bonding material, thereby forming cracks in the bonding layer, wherein at least one crack propagates within the bonding layer; and wherein the at least one device blocks propagation of the at least one crack, thereby reducing the possibility of damage to the liquid-tight sealing between the first and second insulation walls.

A further aspect of the invention provides a method of making the foregoing tank, which comprises: providing the first insulation wall and the third insulation wall integrated to the first insulation wall; providing the second insulation wall and the fourth insulation wall integrated to the second insulation wall; arranging the first insulation wall and the second insulation wall such that the second insulation wall abuts the first insulation wall; placing the at least one device over the first and second surfaces; applying a curable material over the at least one device, the first surface and the second surface; placing the joint sheet over the curable material such that the first portion faces the first surface and the second portion faces the second surface, curing the curable material so as to form the bonding layer such that the curable material turns to the bonding material of the bonding layer and that the at least one device is embedded in the bonding material, whereby the first and second insulation walls form the first heat-insulation structure; and placing the interior wall over the third and fourth insulation walls such that the third and fourth insulation walls are interposed between the first heat-insulation structure and the interior wall, whereby the third and fourth insulation walls form the second heat-insulation structure. In the foregoing method, the joint sheet may comprise pre-impregnated composite fibers. The at least one device may comprise at least one selected from the group consisting of a plurality of wires, a plurality of balls, a plurality of particles, a woven net of threads, and a lattice structure. The second heat-insulation structure may further comprise a fifth insulation wall bonded to the joint sheet, such that the fifth insulation wall is interposed between the joint sheet and the interior wall and between the third and fourth insulation wall.

Another further aspect of the invention provides a liquefied natural gas tank, comprising: an interior wall configured to contact a liquefied natural gas; a first heat-insulation structure; a second heat-insulation structure interposed between the first heat-insulation structure and the interior wall; wherein the first heat-insulation structure comprises: a first insulation wall comprising a first surface, a second insulation wall abutting the first insulation wall and comprising a second surface, a joint sheet comprising a first portion and a second portion, the first portion being placed over the first insulation wall, the second portion being placed over the second insulation wall, and a bonding material placed between and bonding the first portion of the joint sheet and the first insulation wall, the bonding material further placed between and bonding the second portion of the joint sheet and the second insulation wall; and wherein the joint sheet comprises a plurality of protrusions protruding toward the first insulation wall, wherein at least part of the plurality of protrusions contacts the first insulation wall, wherein the at least part of the plurality of protrusions is configured to inhibit cracks from propagating in the bonding layer, wherein the bonding of the joint sheet with the first and second insulation walls form a substantially liquid-tight sealing between the first and second insulation walls. In the foregoing tank, the protrusions may be configured to maintain a substantially uniform thickness of the bonding material.

An aspect of the present invention provides a structure and method for bonding heat-insulating protection walls of a liquefied natural gas carrier that can prevent occurrence of poor bonding and reduce a thermal expansion coefficient and a residual thermal stress by interposing a spacer means for maintaining an adhesive agent in a uniform thickness between a fiber-reinforced composite reinforcing sheet and fiber-reinforced composite joint sheets of a heat-insulating protection walls.

Another aspect of the present invention provides a structure and method for bonding heat-insulating protection walls of a liquefied natural gas carrier that can interrupt propagation of cracks and prevent occurrence of fatigue-caused fracture.

One aspect of the present invention provides a structure for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and bonded to one another at a junction to keep the tank cold, the structure comprising: a fiber-reinforced composite joint sheet positioned in alignment with the juncture of the heat-insulating protection walls and bonded to the fiber-reinforced composite reinforcing sheet by an adhesive agent; and a spacer means interposed between the fiber-reinforced composite reinforcing sheet and the fiber-reinforced composite joint sheet for keeping the adhesive agent uniform in thickness. In the foregoing structure, the spacer means is selected from the group consisting of a plurality of wires, a plurality of beads and a fiber mat. The spacer means is selected from the group consisting of a plurality of protrusions and a plurality of grooves formed on one surface of the fiber-reinforced composite joint sheet facing the fiber-reinforced composite reinforcing sheet.

Another aspect of the invention provide a structure for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and bonded to one another at a junction to keep the tank cold, the structure comprising: a prepreg-made joint sheet positioned in alignment with the juncture of the heat-insulating protection walls and bonded to the fiber-reinforced composite reinforcing sheet; and a spacer means interposed between the fiber-reinforced composite reinforcing sheet and the prepreg-made joint sheet for keeping the reinforcing sheet and the joint sheet spaced apart from each other. In the foregoing structure, the spacer means is selected from the group consisting of a plurality of wires, a plurality of beads and a fiber mat. The spacer means is selected from the group consisting of a plurality of protrusions and a plurality of grooves formed on one surface of the prepreg-made joint sheet facing the fiber-reinforced composite reinforcing sheet.

Another aspect of the invention provides a structure for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and bonded to one another at a junction to keep the tank cold, the structure comprising: a fiber-reinforced composite joint sheet positioned in alignment with the juncture of the heat-insulating protection walls and bonded to the fiber-reinforced composite reinforcing sheet; and a spacer means interposed between the fiber-reinforced composite reinforcing sheet and the fiber-reinforced composite joint sheet for keeping the reinforcing sheet and the joint sheet spaced apart from each other, wherein one of the reinforcing sheet and the joint sheet is made of prepregs. In the foregoing structure, the spacer means is selected from the group consisting of a plurality of wires, a plurality of beads and a fiber mat. The spacer means is selected from the group consisting of a plurality of protrusions and a plurality of grooves formed on one surface of the fiber-reinforced composite reinforcing sheet and the fiber-reinforced composite joint sheet.

Another aspect of the present invention provides a method for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and adapted to be bonded to one another at a junction to keep the tank cold, the method comprising the steps of: arranging a spacer means on the fiber-reinforced composite reinforcing sheet at and around the juncture of the heat-insulating protection walls; applying an adhesive agent on the spacer means; attaching a fiber-reinforced composite joint sheet to the adhesive agent; pressing the fiber-reinforced composite joint sheet against the fiber-reinforced composite reinforcing sheet; and curing the adhesive agent to bond the joint sheet to the reinforcing sheet. In the foregoing method, the spacer means is selected from the group consisting of a plurality of wires, a plurality of beads and a fiber mat. The spacer means is selected from the group consisting of a plurality of protrusions and a plurality of grooves formed on one surface of the fiber-reinforced composite joint sheet facing the fiber-reinforced composite reinforcing sheet.

Another aspect of the present invention provides a method for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and adapted to be bonded to one another at a junction to keep the tank cold, the method comprising the steps of: arranging a spacer means on the fiber-reinforced composite reinforcing sheet at and around the juncture of the heat-insulating protection walls; attaching a prepreg-made joint sheet to the spacer means; and pressing the prepreg-made joint sheet against the fiber-reinforced composite reinforcing sheet to bond the joint sheet and the reinforcing sheet together. In the foregoing method, the spacer means is selected from the group consisting of a plurality of wires, a plurality of beads and a fiber mat. The spacer means is selected from the group consisting of a plurality of protrusions and a plurality of grooves formed on one surface of the prepreg-made joint sheet facing the fiber-reinforced composite reinforcing sheet.

Another aspect of the present invention provides a method for bonding heat-insulating protection walls of a liquefied natural gas carrier, each of the heat-insulating protection walls being formed of an insulation foam layer and a fiber-reinforced composite reinforcing sheet attached to a surface of the insulation foam layer, the heat-insulating protection walls being provided in a tank of the liquefied natural gas carrier in a mutually adjoining relationship and adapted to be bonded to one another at a junction to keep the tank cold, the method comprising the steps of: placing a prepreg sheet on the fiber-reinforced composite reinforcing sheet at and around the juncture of the heat-insulating protection walls; placing a fiber-reinforced composite joint sheet on the prepreg sheet; and bonding the reinforcing sheet, the prepreg sheet and the joint sheet together by simultaneous curing. In the foregoing method, the fiber-reinforced composite reinforcing sheet and the fiber-reinforced composite joint sheet are made of prepregs.

BRIEF DESCRIPTION OF THE DRAWINGS

The above and other aspects and features of the present invention will become apparent from the following description of preferred embodiments, given in conjunction with the accompanying drawings, in which.

DETAILED DESCRIPTION OF EMBODIMENTS

Embodiments of the present invention will now be described in detail with reference to the accompanying drawings.

Figure 13:
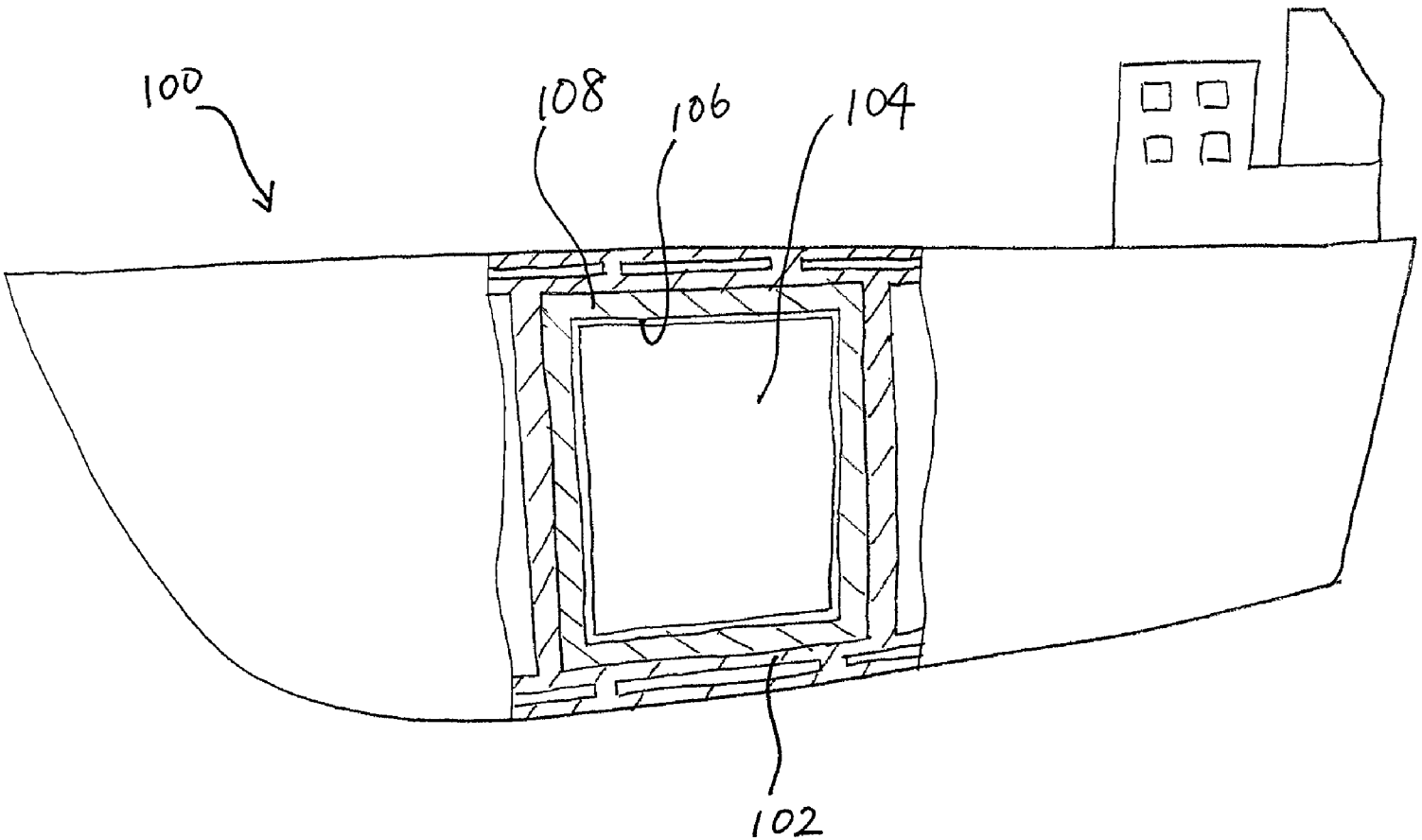
FIG. 13 is a schematic view of a ship which is partially cut away to show the structure of a liquefied natural gas tank.
Figure 14:
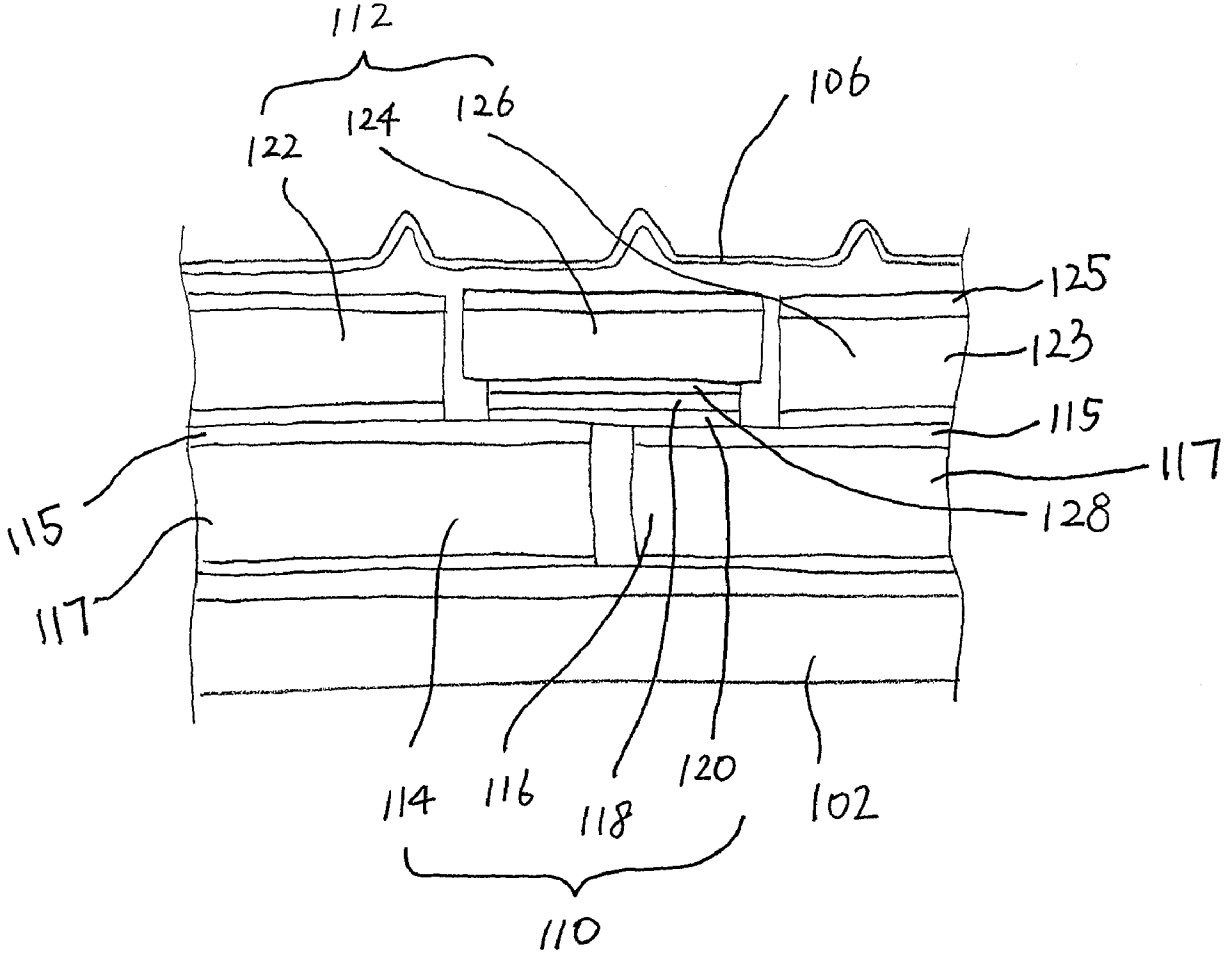
FIG. 14 is an enlarged sectional view of the wall structure of the ship having the liquefied natural gas tank, which is shown in FIG. 13.

Referring to FIG. 13, a liquefied natural gas carrier or ship 100 has an inner hull or structural wall 102 and a liquefied natural gas tank 104 integrated to the structural wall 102. Referring to FIGS. 13 and 14, the tank 104 includes an interior wall 106 and a heat-insulation structure 108 placed between the structural wall 102 and the interior wall 106. The interior wall 106 contacts a liquefied natural gas and is liquid-tight to function as a first barrier or primary barrier. In one embodiment, the interior wall 106 is liquid-tight and may be of stainless steel or invar.

Now referring to FIG. 14, the heat-insulation structure has a first heat-insulation structure 110 and a second heat-insulation structure 112. The second heat-insulation structure 112 is interposed between the first heat-insulation structure 110 and the interior wall 106. In one embodiment, the first heat-insulation structure 110 has an insulation wall 114 and an insulation wall 116, which abutting each other. In one embodiment, each of the insulation walls 114 and 116 has a top layer 115 and a foam layer 117. The top layer forms a liquid-tight layer and includes impregnated composite fibers. The first heat-insulation structure 110 has a joint sheet 118 placed over the insulation wall 114 and the insulation wall 116. A bonding layer 120 is placed between the joint sheet 118 and the insulation wall 114 and liquid-tightly bonds the joint sheet 118 and the top layer of the insulation wall 114. Thus, the first heat-insulation structure can function as a secondary barrier. The bonding layer 120 is further placed between the joint sheet 118 and the insulation wall 116 and liquid-tightly bonds the joint sheet 118 and the top layer of the insulation wall 116.

In one embodiment, the second heat-insulation structure 112 has a plurality of insulation walls 122, 124 and 126. Each of the plurality of insulation walls 122, 124 and 126 has a foam layer 123 and a plywood layer 125. The second heat-insulation structure 112 of the plurality of insulation walls 122, 124 and 126 do not form a liquid-tight sealing. In one embodiment, when making the insulation structure 108, a first integrated sub-assembly of the insulation wall 122 and the insulation wall 114 and a second integrated sub-assembly of the insulating wall 126 and the insulation wall 116 may be provided and arranged such that the insulation wall 114 and 116 abut each other. Subsequently, the joint sheet 118 is bonded to the insulation wall 114 and 116 at an area between the insulation walls 122 and 126 to form the first heat-insulation structure. In one embodiment, the joint sheet 118 is further bonded to the insulation wall or bridge pad 124. In one embodiment, an additional layer 128 is interposed between the joint sheet 120 and the insulation wall 124.

Figure 1:
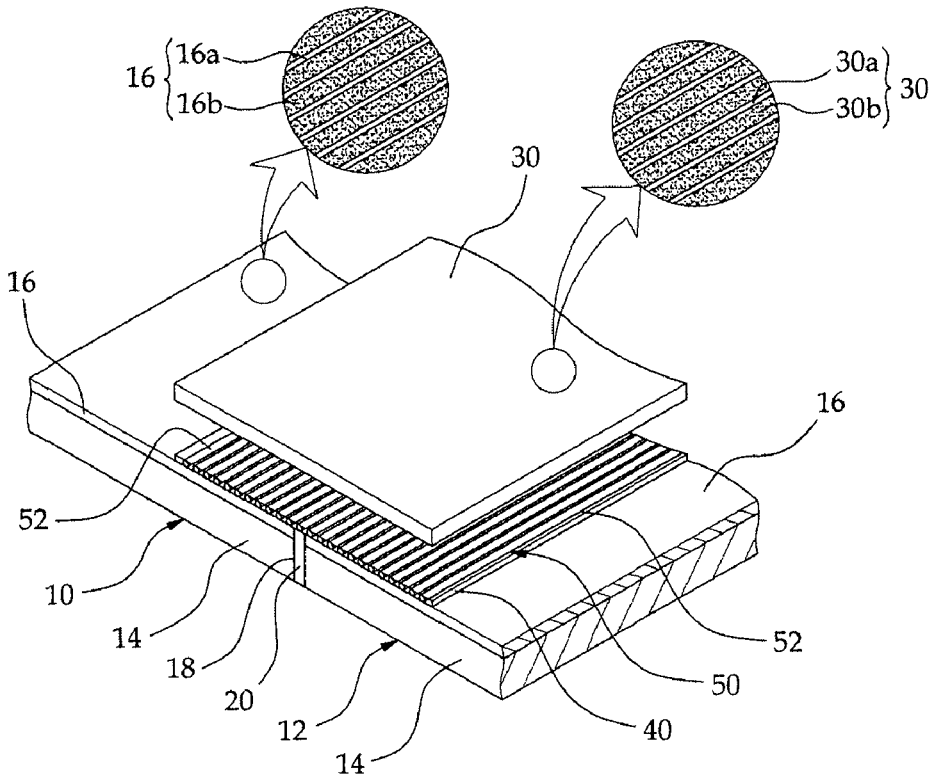
FIG. 1 is a perspective view showing a structure for bonding heat-insulating protection walls according to an embodiment of the present invention.
Figure 2:
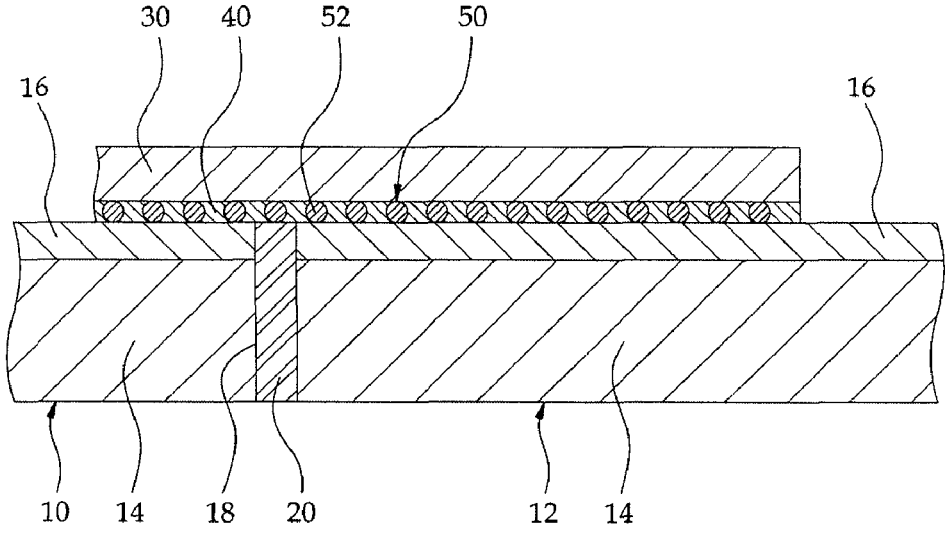
FIG. 2 is a sectional view showing the structure for bonding heat-insulating protection walls according to an embodiment of the present invention.

Referring to FIGS. 1 and 2, there is shown a structure for bonding heat-insulating protection walls of a liquefied natural gas carrier according to an embodiment of the present invention. As shown in FIG. 1, the structure for bonding heat-insulating protection walls of a liquefied natural gas carrier according to an embodiment includes heat-insulating protection walls 10 and 12 provided in a mutually adjoining relationship to keep cold a tank of a liquefied natural gas carrier. Each of the heat-insulating protection walls 10 and 12 consists of an insulation foam layer 14 and a fiber-reinforced composite reinforcing sheet 16 attached to a surface of the insulation foam layer 14. In one embodiment, the insulation foam layers 14 and 16 may be of poly urethane.

A juncture 18 of the heat-insulating protection walls 10 and 12 is filled with putty 20. A fiber-reinforced composite joint sheet 30 is bonded to the juncture 18 of the heat-insulating protection walls 10 and 12. Each of the reinforcing sheet 16 and the joint sheet 30 is composed of a plurality of reinforcing fibers 16*a* or 30*a* and a matrix 16*b* or 30*b* for binding the reinforcing fibers 16*a* or 30*a* together.

The reinforcing fibers 16*a* and 30*a* of the reinforcing sheet 16 and the joint sheet 30 is comprised of glass fibers, carbon fibers, aramid fibers, polyester fibers, polyvinyl acrylic fibers and so forth. Examples of aramid fibers include Kevlar fibers (a brand name of Du Pont Company, U.S.A.), Spectra fibers (a brand name of Honeywell International Inc., U.S.A.) and Dyneema fibers (a brand name of DSM Dyneema B.V., Netherlands). The matrices 16*b* and 30*b* is comprised of epoxy resin, polyester resin, vinylester resin, polyurethane and so forth.

Each of the reinforcing sheet 16 and the joint sheet 30 is prepared from prepregs, which in turn is produced in the form of a sheet or a laminate by immersing the reinforcing fibers 16*a* and 30*a* in the matrices 16*b* and 30*b* and curing matrices 16*b* and 30*b* in a B-stage state. The reinforcing fibers 16*a* and 30*a* of the prepregs may consist of long fibers arranged in a single direction. As an alternative, the reinforcing fibers 16*a* and 30*a* of the prepregs may consist of short fibers uniformly dispersed and cross-linked in a matrix. Each of the reinforcing sheet 16 and the joint sheet 30 may be formed of a woven fabric prepreg, which in turn is produced by weaving yarns of reinforcing fibers into a woven fabric, adding a matrix to the woven fabric and molding them into a sheet shape. Seeing that the reinforcing fibers are interlaced in the woven fabric prepreg, the woven fabric prepreg exhibits high resistance against a fracture in structure, e.g., interlayer peeling.

With the structure for bonding heat-insulating protection walls of a liquefied natural gas carrier according to an embodiment of the present invention, a spacer means 50 for keeping uniform the thickness of the adhesive agent 40 is interposed between the reinforcing sheet 16 and the joint sheet 30.

Referring to FIGS. 1 and 2, the spacer means 50 is comprised of a plurality of wires 52 each having a circular cross section. The wires 52 are arranged in a specified interval between the reinforcing sheet 16 and the joint sheet 30. As can be seen in FIG. 1, the wires 52 extend in parallel to the juncture 18 of the heat-insulating protection walls 10 and 12. Alternatively, the wires 52 may run across the juncture 18 or may intersect with one another at a right angle.

Figure 3:
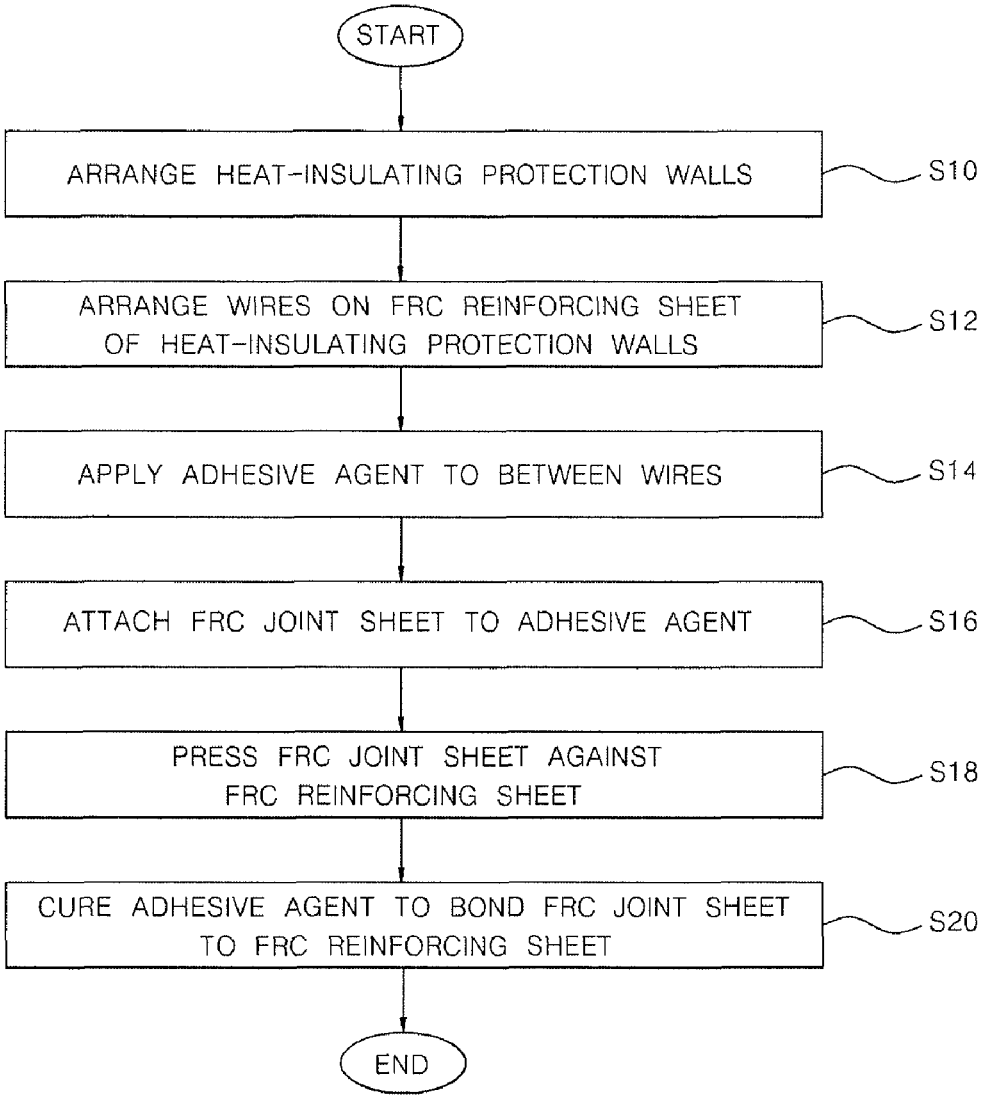
FIG. 3 is a flowchart illustrating a method for bonding heat-insulating protection walls according to an embodiment of the present invention.

FIG. 3 illustrates a method for bonding heat-insulating protection walls of a liquefied natural gas carrier according to an embodiment of the present invention. The method for bonding heat-insulating protection walls of a liquefied natural gas carrier shown in FIG. 3 will now be described with reference to FIGS. 1 and 2.

A first step is to suitably arrange the heat-insulating protection walls 10 and 12 consisting of the insulation foam layer 14 and the reinforcing sheet 16 attached to the surface of the insulation foam layer 14 (step S10). At this time, the juncture 18 at which the heat-insulating protection walls 10 and 12 meet is filled with putty 20. The wires 52 are arranged in a specified interval at and around the juncture 18 of the heat-insulating protection walls 10 and 12 (step S12), after which the adhesive agent 40 is applied between the wires 52 (step S14).

Next, the joint sheet 30 is attached to the adhesive agent 40 (step S16). Then, the joint sheet 30 is pressed against the reinforcing sheet 16 (step S18) and the joint sheet 30 is bonded to the reinforcing sheet 16 by curing the adhesive agent 40 (step S20). The task of pressing the joint sheet 30 is performed by pushing the surface of the joint sheet 30 with pressing means such as a roller, an air bag, an air pad or the like.

As the wires 52 of a circular cross section serving as the spacer means 50 are interposed between the reinforcing sheet 16 and the joint sheet 30, the adhesive agent 40 is kept uniform in thickness. This prevents poor bonding of the joint sheet 30, while reducing a thermal expansion coefficient and a residual thermal stress. Furthermore, it becomes possible to interrupt propagation of cracks which would be generated in the bonding surface of the joint sheet 30, thereby greatly improving reliability.

Figure 4:
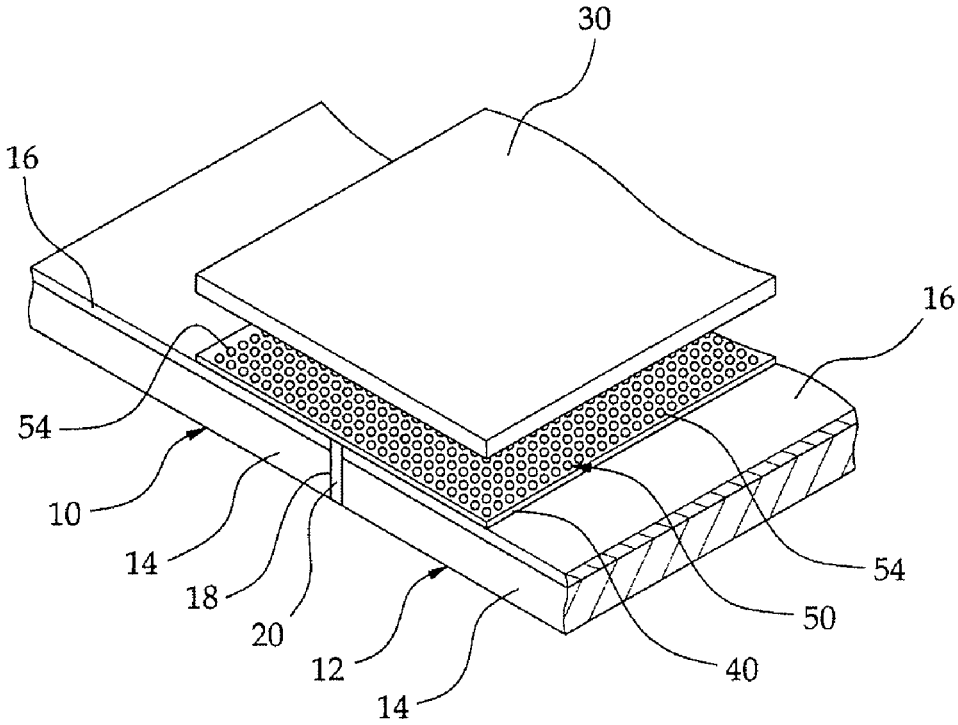
FIG. 4 is a perspective view showing a structure for bonding heat-insulating protection walls according to an embodiment of the present invention.

FIG. 4 shows a structure for bonding heat-insulating protection walls of a liquefied natural gas carrier according to an embodiment of the present invention. Referring to FIG. 4, in the structure for bonding heat-insulating protection walls of a liquefied natural gas carrier according to an embodiment, a plurality of beads 54 serving as the spacer means 50 for keeping uniform the thickness of the adhesive agent 40 is interposed between the reinforcing sheet 16 and the joint sheet 30. The beads 54 can be uniformly interposed between the reinforcing sheet 16 and the joint sheet 30 by evenly mixing the beads 54 with the adhesive agent 40 and applying the mixture of the beads 54 and the adhesive agent 40 on the surface of the reinforcing sheet 16. Just like the wires 52 set forth above, the beads 54 thus interposed function to keep uniform the thickness of the adhesive agent 40.

Figure 5:
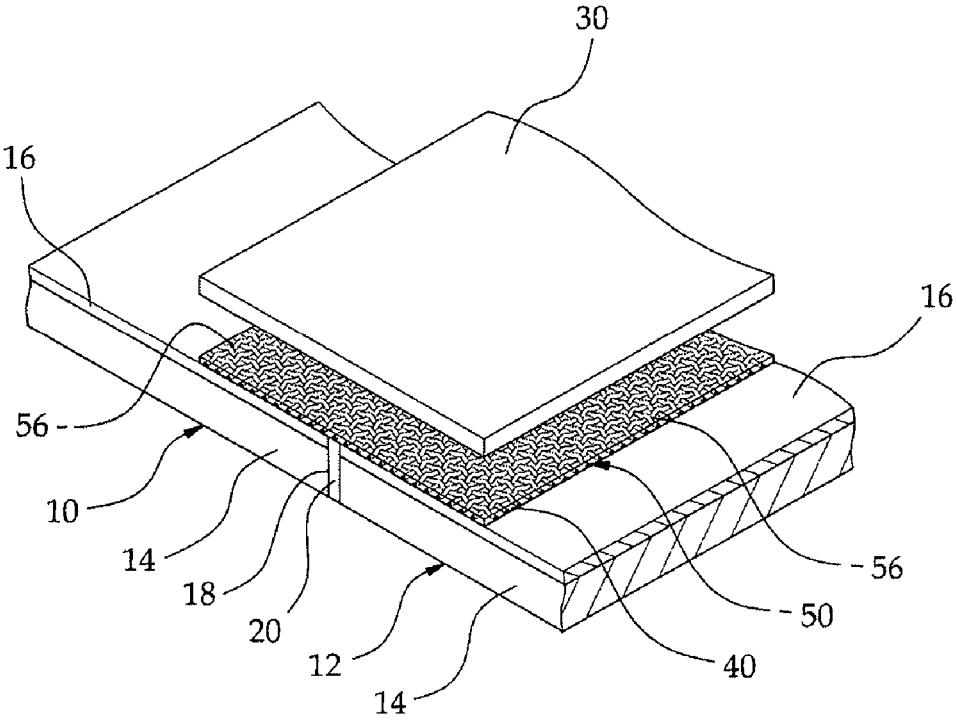
FIG. 5 is a perspective view showing a structure for bonding heat-insulating protection walls according to an embodiment of the present invention.
Figure 15:
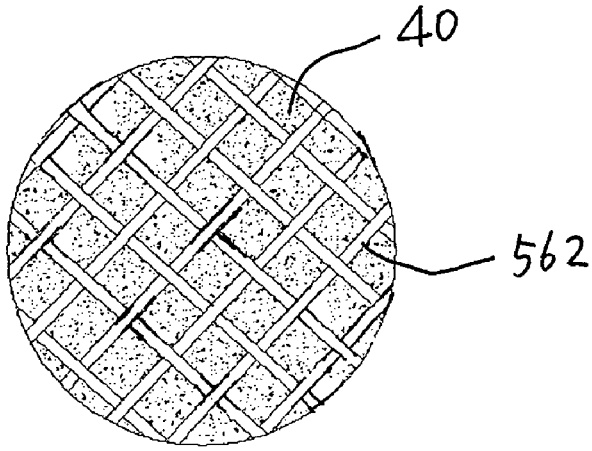
FIG. 15 is an enlarged view of a net or mat shown in FIG. 5.

FIG. 5 shows a structure for bonding heat-insulating protection walls of a liquefied natural gas carrier according to an embodiment of the present invention. Referring to FIG. 5, in the structure for bonding heat-insulating protection walls of a liquefied natural gas carrier according to an embodiment, a fiber mat or net 56 serving as the spacer means 50 for keeping uniform the thickness of the adhesive agent 40 is interposed between the reinforcing sheet 16 and the joint sheet 30. The fiber mat 56 may be formed of reinforcing fibers such as glass fibers, carbon fibers or the like. The adhesive agent 40 permeates into the fiber mat 56 to thereby bond the reinforcing sheet 16 and the joint sheet 30 together in a uniform thickness. In one embodiment, the mat 56 may be a woven net of threads 562, as shown in FIG. 15.

Figure 6:
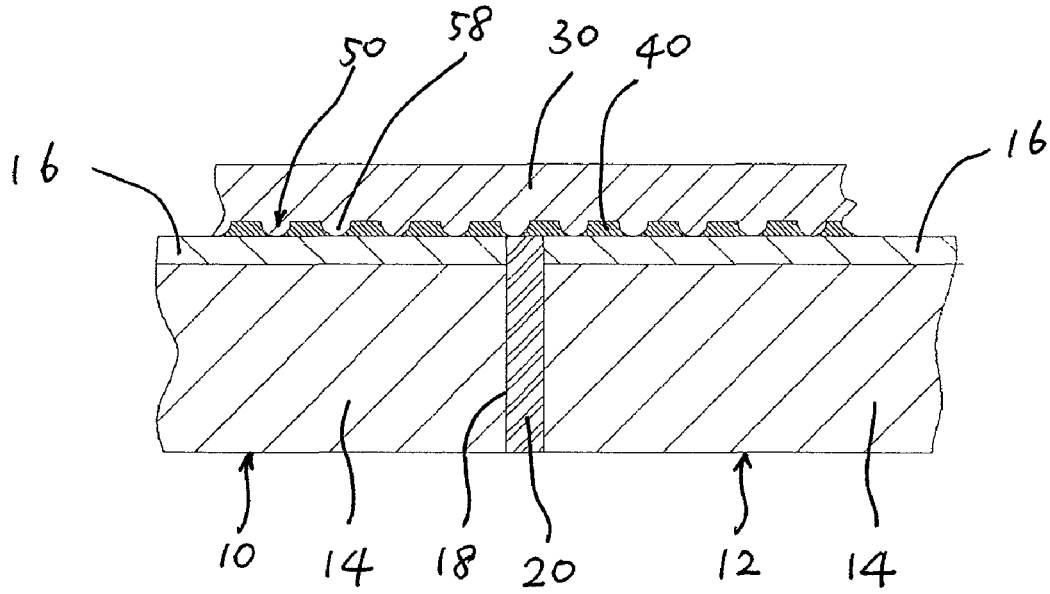
FIG. 6 is a sectional view showing a structure for bonding heat-insulating protection walls according to an embodiment of the present invention.

FIG. 6 shows a structure for bonding heat-insulating protection walls of a liquefied natural gas carrier according to an embodiment of the present invention. Referring to FIG. 6, in the structure for bonding heat-insulating protection walls of a liquefied natural gas carrier according to an embodiment, a plurality of protrusions 58 projecting from one surface of the joint sheet 30 toward the reinforcing sheet 16 is used as the spacer means 50 for keeping uniform the thickness of the adhesive agent 40 in between the reinforcing sheet 16 and the joint sheet 30. Just like the wires 52, the beads 54 and the fiber mat 56 set forth above, the protrusions 58 thus formed serve to keep uniform the thickness of the adhesive agent 40. In one embodiment, the protrusions 58 contact either the reinforcing sheet 16.

As illustrated in FIG. 6, the protrusions 58 have a semi-circular cross section. If necessary, the cross section of the protrusions 58 may be arbitrarily changed to a triangular shape, a rectangular shape or other shapes. Furthermore, the protrusions 58 may be formed to rectilinearly extend in parallel to or in an intersecting relationship with the juncture 18 of the heat-insulating protection walls 10 and 12 or may be formed in a lattice shape. Although the protrusions 58 are formed in the joint sheet 30 in the foregoing description, they may be provided in the reinforcing sheet 16.

Figure 7:
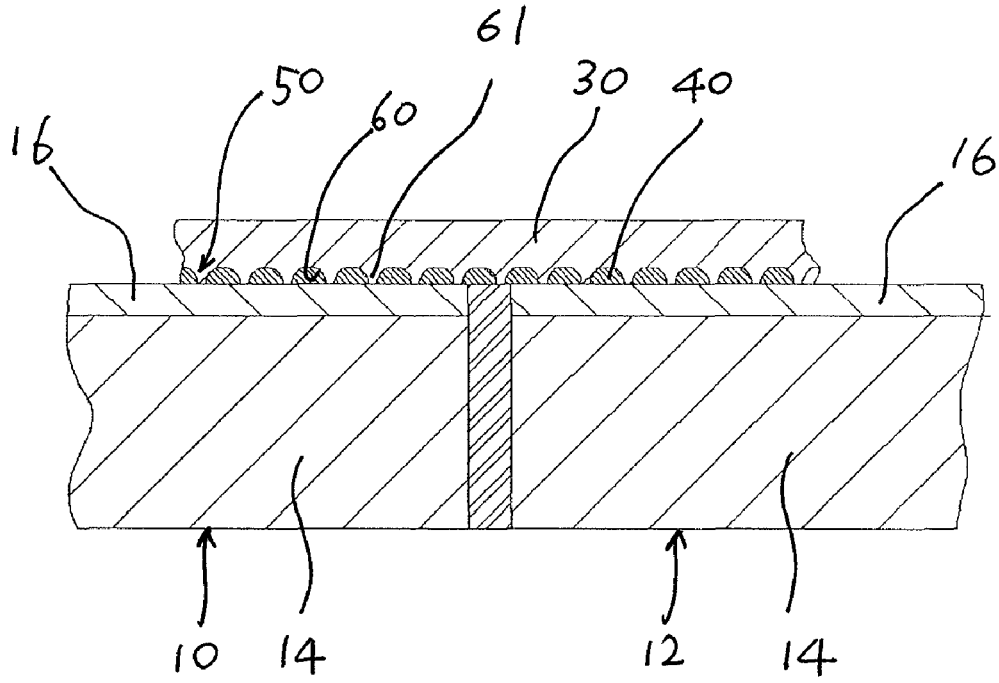
FIG. 7 is a sectional view showing a structure for bonding heat-insulating protection walls according to an embodiment of the present invention.

FIG. 7 shows a structure for bonding heat-insulating protection walls of a liquefied natural gas carrier according to an embodiment of the present invention. Referring to FIG. 7, in the structure for bonding heat-insulating protection walls of a liquefied natural gas carrier according to an embodiment, a plurality of grooves 60 formed on one surface of the joint sheet 30 facing the reinforcing sheet 16 is used as the spacer means 50 for keeping uniform the thickness of the adhesive agent 40 in between the reinforcing sheet 16 and the joint sheet 30. Since the adhesive agent 40 excessively applied flows into the grooves 60, it is possible to keep uniform the thickness of the adhesive agent 40 in between the reinforcing sheet 16 and the joint sheet 30. In one embodiment, the grooves 60 are formed between protrusions 61 which contact the reinforcing sheet 16.

As illustrated in FIG. 7, the grooves 60 have a semi-circular cross section. If necessary, the cross section of the grooves 60 may be arbitrarily changed to a triangular shape, a rectangular shape or other shapes. Furthermore, the grooves 60 may be formed to rectilinearly extend in parallel to or in an intersecting relationship with the juncture 18 of the heat-insulating protection walls 10 and 12 or may be formed in a lattice shape. Although the grooves 60 are formed in the joint sheet 30 in the foregoing description, they may be provided in the reinforcing sheet 16.

Figure 8:
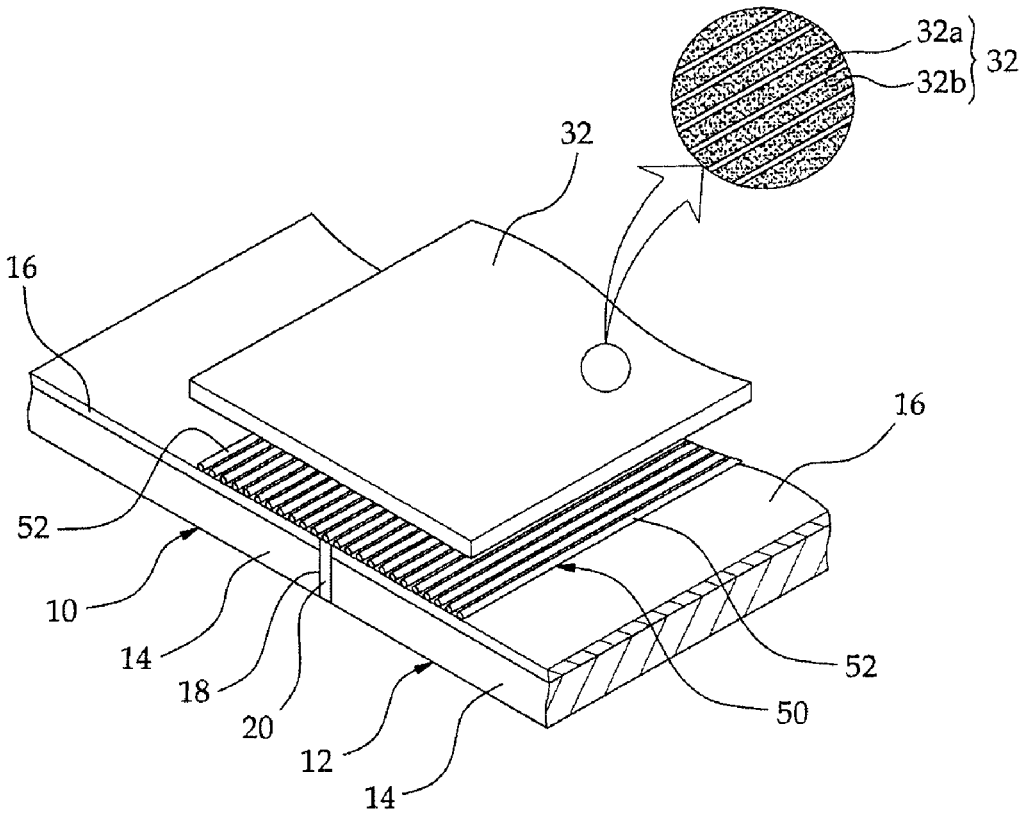
FIG. 8 is a perspective view showing a structure for bonding heat-insulating protection walls according to an embodiment of the present invention.

FIG. 8 shows a structure for bonding heat-insulating protection walls of a liquefied natural gas carrier according to an embodiment of the present invention. Referring to FIG. 8, a prepreg-made joint sheet 32 is bonded to the juncture 18 of the heat-insulating protection walls 10 and 12. The prepreg-made joint sheet 32 is prepared by immersing reinforcing fibers 32*a* in a matrix 32*b* and curing the matrix 32*b* in a B-stage state. A plurality of wires 52 serving as the spacer means 50 is interposed between the reinforcing sheet 16 of the heat-insulating protection walls 10 and 12 and the prepreg-made joint sheet 32. The wires 52 as the spacer means 50 may be substituted by the fiber mat 56, the protrusions 58 or the grooves 60, the latter two of which are formed in the prepreg-made joint sheet 32. Just like the prepreg-made joint sheet 32, the reinforcing sheet 16 may be comprised of a prepreg-made reinforcing sheet.

Figure 9:
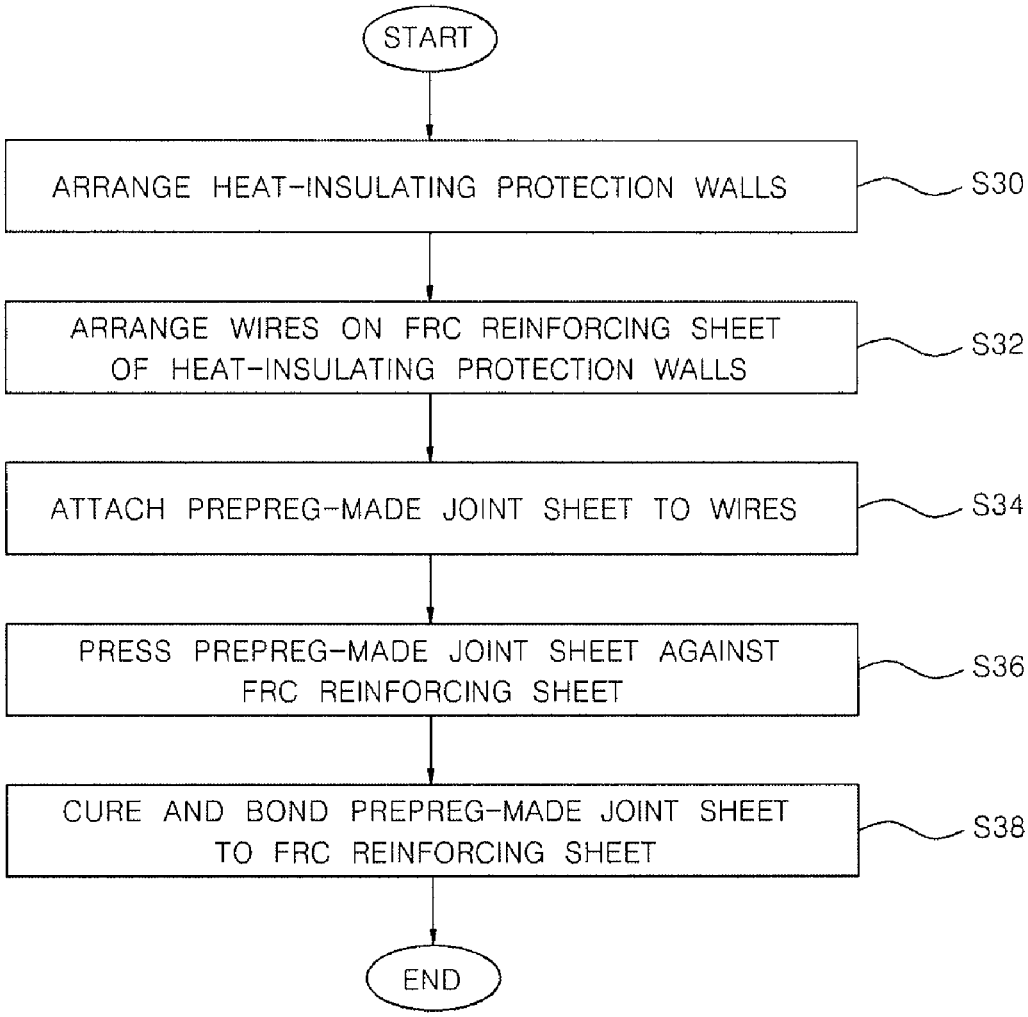
FIG. 9 is a flowchart illustrating a method for bonding heat-insulating protection walls according to an embodiment of the present invention.

FIG. 9 illustrates a method for bonding heat-insulating protection walls according to an embodiment of the present invention. The method for bonding heat-insulating protection walls according to an embodiment illustrated in FIG. 9 will now be described with reference to FIG. 8.

A first step is to suitably arrange the heat-insulating protection walls 10 and 12 consisting of the insulation foam layer 14 and the reinforcing sheet 16 attached to the surface of the insulation foam layer 14 (step S30). The wires 52 are arranged in a specified interval on the reinforcing sheet 16 at and around the juncture 18 of the heat-insulating protection walls 10 and 12 (step S32), after which the prepreg-made joint sheet 32 is attached to the wires 52 (step S34).

Next, the prepreg-made joint sheet 32 is pressed against the reinforcing sheet 16 (step S36). The task of pressing the prepreg-made joint sheet 32 is performed by pushing the surface of the prepreg-made joint sheet 32 with s-pressing means such as a roller or the like. By pressing the prepreg-made joint sheet 32 in this manner, the matrix 32*b* remaining in a B-stage state is filled between the wires 52. The matrix 32*b* filled between the wires 52 serves as an adhesive agent for bonding the reinforcing sheet 16 and the prepreg-made joint sheet 32 together. Finally, the prepreg-made joint sheet 32 is cured to ensure that the prepreg-made joint sheet 32 is bonded to the reinforcing sheet 16 (step S38).

In a nutshell, the wires 52 are interposed between the reinforcing sheet 16 and the prepreg-made joint sheet 32 and then the prepreg-made joint sheet 32 is pressed against and bonded to the reinforcing sheet 16. Thus, the spacing between the reinforcing sheet 16 and the prepreg-made joint sheet 32, i.e., the thickness of the matrix 32*b*, is kept uniform by means of the wires 52. This prevents poor bonding between the reinforcing sheet 16 and the prepreg-made joint sheet 32, while reducing a thermal expansion coefficient and a residual thermal stress. Furthermore, it becomes possible to interrupt propagation of cracks which would be generated in the bonding portion of the reinforcing sheet 16 and the prepreg-made joint sheet 32, thereby avoiding a fatigue fracture and greatly improving reliability. The step of bonding the prepreg-made joint sheet 32 is easier to perform than the step of bonding the fiber-reinforced composite joint sheet 30 mentioned earlier.

Figure 10:
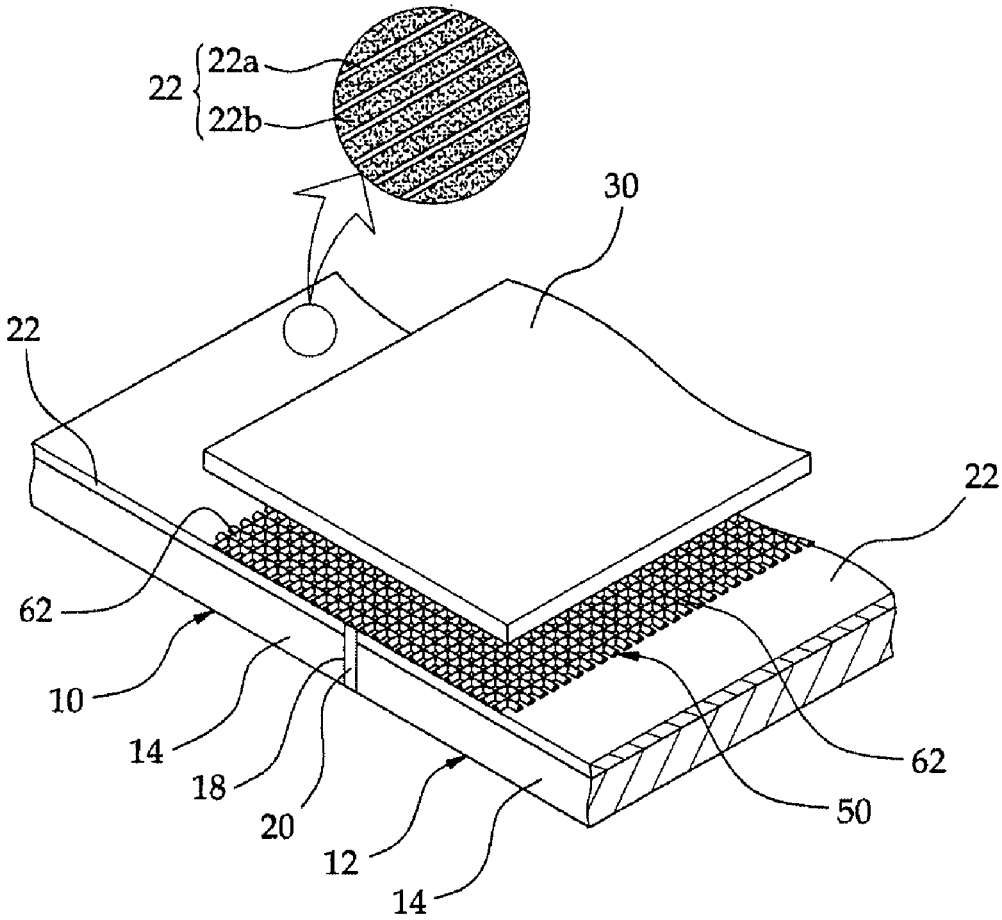
FIG. 10 is a perspective view showing a structure for bonding heat-insulating protection walls according to an embodiment of the present invention.

FIG. 10 shows a structure for bonding heat-insulating protection walls of a liquefied natural gas carrier according to an embodiment of the present invention. Referring to FIG. 10, each of the heat-insulating protection walls 10 and 12 consists of an insulation foam layer 14 and a prepreg-made reinforcing sheet 22 attached to a surface of the insulation foam layer 14. A juncture 18 of the heat-insulating protection walls 10 and 12 is filled with putty 20. A fiber-reinforced composite joint sheet 30 is bonded to the juncture 18 of the heat-insulating protection walls 10 and 12. The joint sheet 30 may be substituted by the prepreg-made joint sheet 32 as shown in FIG. 8. The prepreg-made reinforcing sheet 22 is prepared by immersing reinforcing fibers 22*a* in a matrix 22*b* and curing the matrix 22*b* in a B-stage state.

Figure 16:
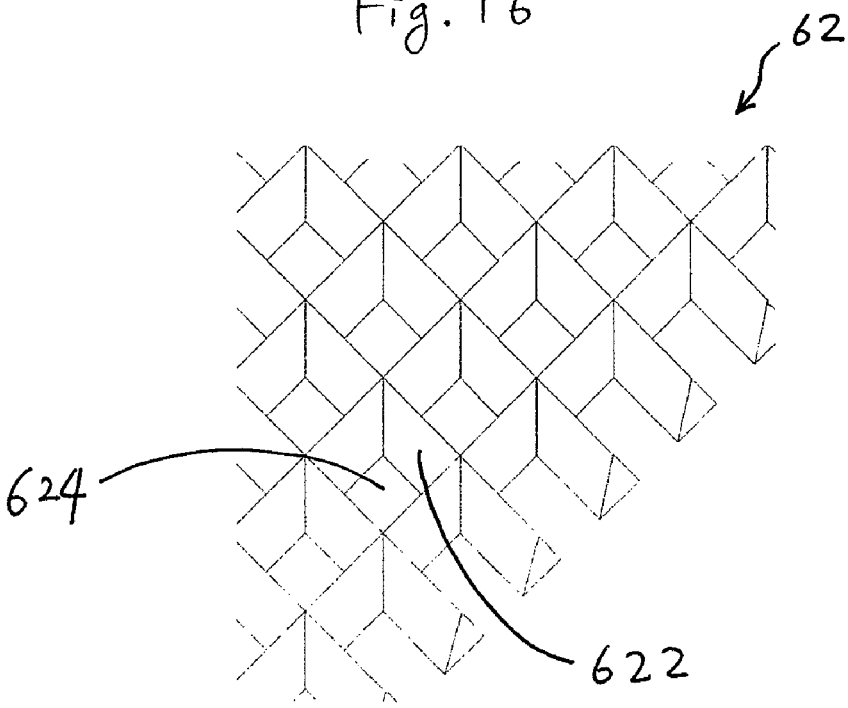
FIG. 16 is an enlarged view of a lattice structure shown in FIG. 10.

In one embodiment, a lattice structure 62 serving as a spacer means 50 is placed on a surface of the prepreg-made reinforcing sheet 22 facing the joint sheet 30. As shown in FIG. 16, the lattice structure 62 has a plurality of ribs 622 interconnected each other and defining holes 624. Referring to FIGS. 10 and 18, when the joint sheet 30 is pressed against the prepreg-made reinforcing sheet 22, the matrix 22*b* remaining in the B-stage state is filled between the ribs 622. The matrix 22*b* filled between the ribs 622 serves as an adhesive agent for bonding the prepreg-made reinforcing sheet 22 and the joint sheet 30 together. The lattice structure 62 serving as the spacer means 50 are adapted to keep uniform the thickness of the matrix 22*b* between the prepreg-made reinforcing sheet 22 and the joint sheet 30.

Figure 11:
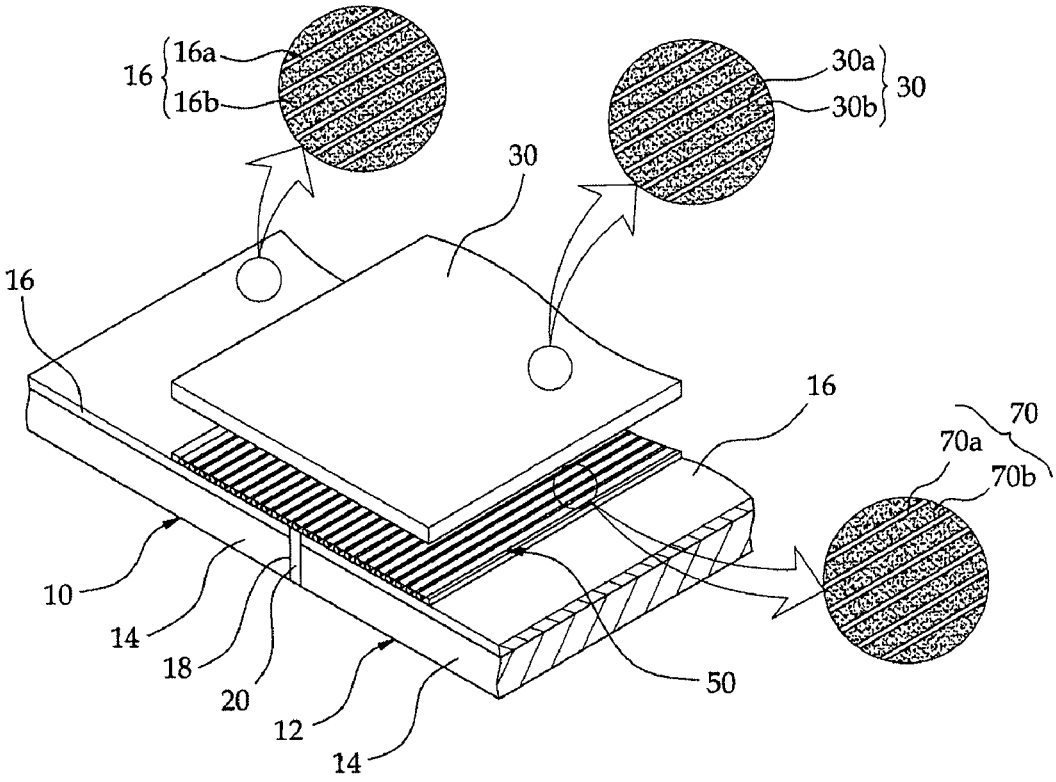
FIG. 11 is a perspective view showing a structure for bonding heat-insulating protection walls according to an embodiment of the present invention.
Figure 12:
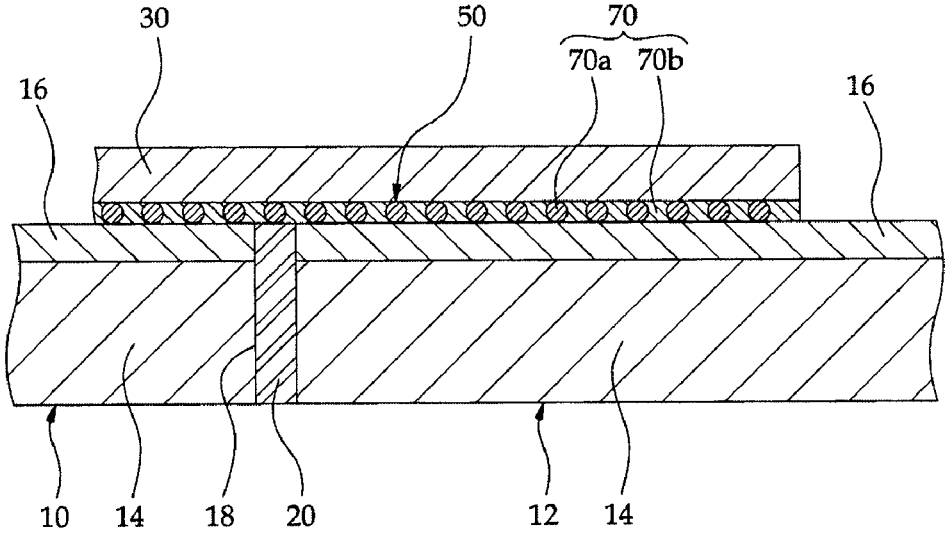
FIG. 12 is a sectional view showing the structure for bonding heat-insulating protection walls according to an embodiment of the present invention.

FIGS. 11 and 12 show a structure for bonding heat-insulating protection walls of a liquefied natural gas carrier according to an embodiment of the present invention. Referring to FIGS. 11 and 12, each of the heat-insulating protection walls 10 and 12 consists of an insulation foam layer 14 and a fiber-reinforced composite reinforcing sheet 16 attached to a surface of the insulation foam layer 14. A juncture 18 of the heat-insulating protection walls 10 and 12 is filled with putty 20. A fiber-reinforced composite joint sheet 30 is bonded to the juncture 18 of the heat-insulating protection walls 10 and 12.

A prepreg sheet 70 serving as a spacer means 50 is bonded to the joint sheet 30, whereas the joint sheet 30 is bonded to the prepreg sheet 70. The prepreg sheet 70 is prepared in the form of a sheet or a laminate by immersing a plurality of reinforcing fibers 70*a* in a matrix 70*b* and curing the matrix 70*b* in a B-stage state. The reinforcing fibers 70*a* may be comprised of long fibers or short fibers. Furthermore, the prepreg sheet 70 may be comprised of woven fabric prepregs.

The reinforcing sheet 16, the joint sheet 30 and the prepreg sheet 70 are simultaneously cured and bonded together in a state that the prepreg sheet 70 is interposed between the reinforcing sheet 16 and the joint sheet 30. If necessary, the reinforcing sheet 16 and the joint sheet 30 may be formed of prepregs. By interposing the prepreg sheet 70 cured in the B-stage state between the reinforcing sheet 16 and the joint sheet 30 as the spacer means 50 and bonding them together through simultaneous curing in this manner, it is possible to simplify the bonding process and to keep uniform the spacing between the reinforcing sheet 16 and the joint sheet 30. This prevents poor bonding of the reinforcing sheet 16 and the joint sheet 30 and reduces a thermal expansion coefficient and a residual thermal stress, thereby avoiding a fatigue-caused fracture and greatly improving reliability.

In one embodiment, the reinforcing sheet, the joint sheet or the bonding layer has a resin material and bundles or strands of fibers. The bundles or strands are embedded in the resin material. The filaments may be of glass fibers or carbon fibers. In one embodiment, the diameter of the bundle or strand may be about 0.1 mm to about 1.0 mm.

In one embodiment, the adhesive or bonding material may be of thermoset resin material, for example, epoxy, polyester, phenol or poly urethane. In another embodiment, the adhesive or bonding material may contain carbon black, nano clay particles or chopped glass fibers to improve mechanical properties such as strength.

The embodiments set forth hereinabove have been presented for illustrative purpose only and, therefore, the present invention is not limited to these embodiments. It will be understood by those skilled in the art that various changes and modifications may be made without departing from the scope of the invention defined in the claims.

What is claimed is:

1. A liquefied natural gas tank, comprising:

an interior wall configured to contact a liquefied natural gas;

a first heat-insulation structure;

a second heat-insulation structure interposed between the first heat-insulation structure and the interior wall; and wherein the first heat-insulation structure comprises:

a first insulation wall comprising a first surface, a second insulation wall laterally abutting the first insulation wall and comprising a second surface, a joint sheet comprising a first portion and a second portion, the first portion being placed over the first insulation wall, the second portion being placed over the second insulation wall, and a bonding layer placed between and bonding the first portion of the joint sheet and the first insulation wall, the bonding layer further placed between and bonding the second portion of the joint sheet and the second insulation wall, wherein the bonding layer comprises a bonding material and at least one device embedded in the bonding material, wherein the at least one device comprises two opposing surfaces, one of which contacts the joint sheet and the other of which contacts the first insulation wall, wherein the at least one device is configured to inhibit cracks from propagating in the bonding layer, wherein the bonding of the joint sheet with the first and second insulation walls forms a substantially liquid-tight sealing between the first and second insulation walls.

2. The tank of claim 1, wherein the at least one device is further configured to maintain a substantially uniform thickness of the bonding layer.

3. The tank of claim 1, wherein the at least one device comprises at least one selected from the group consisting of a plurality of wires, a plurality of balls, a plurality of particles, a woven net of threads, and a lattice structure.

4. The tank of claim 1, wherein the at least one device comprises at least one selected from the group consisting of a plurality of metallic wires, a plurality of glass fibers, and a plurality of carbon fibers.

5. The tank of claim 1, wherein the at least one device comprises a woven net of a plurality of threads which comprise at least one of glass fiber strands and carbon fiber strands.

6. The tank of claim 1, wherein the at least one device comprises a lattice structure comprising a plurality of holes, wherein the bonding material is placed in at least part of the plurality of holes.

7. The tank of claim 1, wherein the second heat-insulation structure comprises a third insulation wall and a fourth insulation wall, which do not form a liquid-tight sealing therebetween.

8. The tank of claim 7, wherein the third insulation wall is integrated with the first insulation wall, wherein the fourth insulation wall is integrated with the second insulation wall.

9. The tank of claim 1, wherein the cracks are to form in the bonding material as at least one of the joint sheet, the first insulating wall, the second insulating wall and the bonding material shrinks or expands upon a substantial change of a surrounding temperature.

10. The tank of claim 1, wherein the first and second insulation walls have a gap therebetween, and wherein the first heat-insulation structure further comprises a filler placed in the gap, wherein the bonding layer is formed further between the filler and the joint sheet.

11. The tank of claim 1, wherein the joint sheet comprises a fiber-reinforced resin.

12. The tank of claim 1, wherein the first insulation wall comprises a plurality of layers which comprises a top layer contacting the bonding layer, wherein the top layer comprises a fiber-reinforced resin.

13. A method of minimizing damage to liquid-tight sealing in loading of liquefied natural gas into a tank, the method comprising:

providing the tank of claim 1; and loading liquefied natural gas into the tank, which substantially lowers a temperature surrounding the bonding layer, causing to shrink at least one of the joint sheet, the first insulating wall, the second insulating wall and the bonding material, thereby forming cracks in the bonding layer, wherein at least one crack propagates within the bonding layer;

wherein the at least one device blocks propagation of the at least one crack, thereby reducing the possibility of damage to the liquid-tight sealing between the first and second insulation walls.

14. A method of making the tank of claim 7, the method comprising:

providing the first insulation wall and the third insulation wall integrated to the first insulation wall;

providing the second insulation wall and the fourth insulation wall integrated to the second insulation wall;

arranging the first insulation wall and the second insulation wall such that the second insulation wall laterally abuts the first insulation wall;

placing the at least one device over the first and second surfaces;

applying a curable material over the at least one device, the first surface and the second surface;

placing the joint sheet over the curable material such that the first portion faces the first surface and the second portion faces the second surface;

curing the curable material so as to form the bonding layer such that the curable material turns to the bonding material of the bonding layer and that the at least one device is embedded in the bonding material, whereby the first and second insulation walls form the first heat-insulation structure; and placing the interior wall over the third and fourth insulation walls such that the third and fourth insulation walls are interposed between the first heat-insulation structure and the interior wall, whereby the third and fourth insulation walls form the second heat-insulation structure.

15. The method of claim 14, wherein the joint sheet comprises pre-impregnated composite fibers.

16. The method of claim 14, wherein the at least one device comprises at least one selected from the group consisting of a plurality of wires, a plurality of balls, a plurality of particles, a woven net of threads, and a lattice structure.

17. The method of claim 14, wherein the second heat-insulation structure further comprises a fifth insulation wall bonded to the joint sheet, such that the fifth insulation wall is interposed between the joint sheet and the interior wall and between the third and fourth insulation wall.

18. The tank of claim 1, wherein the bonding layer comprises two bonding material sections separate from each other by the at least one device, each bonding material section having a thickness which substantially defines a distance between the joint sheet and the first insulation wall.

* * * * *